United States Patent [19]

Wright et al.

[11] Patent Number: 4,746,519

[45] Date of Patent: May 24, 1988

[54] COFFEE BAGS

[76] Inventors: Darlene J. Wright, R.R. #3, Oregon, Ill. 61061; George Spector, 233 Broadway, Rm. 3615, New York, N.Y. 10007

[21] Appl. No.: 944,940

[22] Filed: Dec. 22, 1986

[51] Int. Cl.[4] ..... B65B 29/02

[52] U.S. Cl. ..... 426/83; 206/0.5; 99/287; 99/295; 99/323; 426/77; 426/111; 426/112; 426/80; 383/2

[58] Field of Search ..... 426/77–84, 426/111; 99/287, 295, 321, 322, 323; 206/0.5

[56] References Cited

U.S. PATENT DOCUMENTS

| | | | |
|---|---|---|---|
| 1,428,046 | 9/1922 | Mock | 99/287 |
| 1,723,702 | 8/1929 | Mitchell | 206/0.5 |
| 2,881,910 | 4/1959 | Murphy | 206/0.5 |
| 2,925,171 | 2/1960 | Eaton | 426/83 |
| 3,692,536 | 9/1972 | Fant | 426/79 |
| 3,833,740 | 9/1974 | Schmidt | 426/80 |
| 4,025,655 | 5/1977 | Whyte et al. | 426/77 |
| 4,141,997 | 2/1979 | Syroka et al. | 99/321 |
| 4,410,550 | 10/1983 | Gaskill | 426/77 |
| 4,446,158 | 5/1984 | English et al. | 426/79 |

FOREIGN PATENT DOCUMENTS

| | | | |
|---|---|---|---|
| 2327264 | 1/1975 | Fed. Rep. of Germany | 426/77 |
| 341713 | 1/1931 | United Kingdom | 99/287 |

*Primary Examiner*—Steven Weinstein

[57] ABSTRACT

A coffee bag is provided and consists of a housing fabricated out of two sheets of water-permeable paper material heat sealed around its perimeter for holding a portion of very fine ground coffee therebetween for making an individual cup of coffee. In a modification the housing is cylindrical and expandable when inserted within hot water and contains a ground coffee agitating device built into the housing.

2 Claims, 1 Drawing Sheet

COFFEE BAGS

BACKGROUND OF THE INVENTION

The instant invention relates generally to packets for brewing coffee and more specifically it relates to a coffee bag.

Numerous packets for brewing coffee have been provided in prior art that are adapted to hold an individual portion of ground coffee for insertion into a cup for making one serving of brewed coffee. For example, U.S. Pat. Nos. 2,157,656; 2,786,761 and 3,640,727 all are illustrative of such prior art. While these units may be suitable for the particular purpose to which they address, they would not be as suitable for the purposes of the present invention as heretofore described.

SUMMARY OF THE INVENTION

A primary object of the present invention is to provide a coffee bag that will overcome the shortcomings of the prior art devices.

Another object is to provide a coffee bag for holding a portion of very fine ground coffee for making an individual cup of coffee when hot water is poured into the cup.

An additional object is to provide a coffee bag that is expandable when inserted within hot water and contains a ground coffee agitating device built into the coffee bag.

A further object is to provide a coffee bag that is simple and easy to use.

A still further object is to provide a coffee bag that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
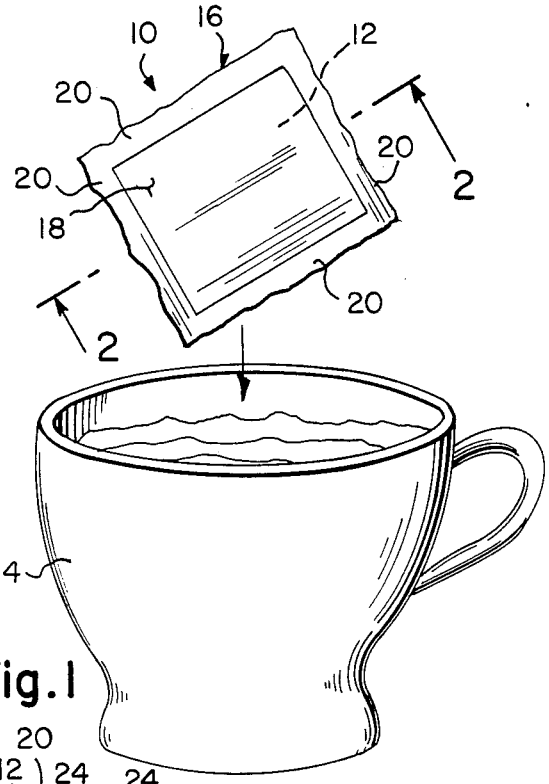
FIG. 1 is a perspective view of a cup with the invention ready to be inserted therein.
Figure 2:
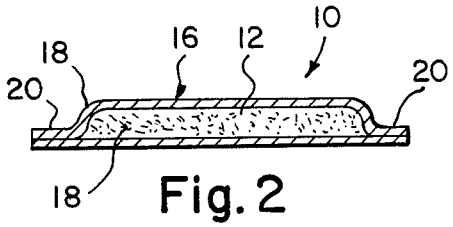
FIG. 2 is a cross sectional view taken along line 2—2 in FIG. 1 showing the very fine ground coffee inside the housing of the bag.

Turning now descriptively to the drawings, in which similar reference characters denote similar elements throughout the several views, FIGS. 1 and 2 illustrate a coffee bag 10 that consists of a portion of very fine ground coffee 12 for making an individual cup of coffee 14. A housing 16 is provided and is fabricated out of two sheets of water permeable paper material 18 heat sealed around its perimeter 20 in a face to face relationship for holding the very fine ground coffee 12 therebetween.

Figure 1A:
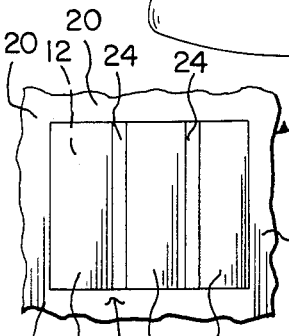
FIG. 1A is a front view of a modified coffee bag having three compartments.

As shown in FIG. 1A the housing 16 of the coffee bag 10 can further include a plurality of compartments 22, here shown as three, being heat sealed at 24 therebetween to increase flow through action of hot water past the very fine ground coffee 12 in each of the compartments 22 when making the individual cup of coffee.

Figure 3:
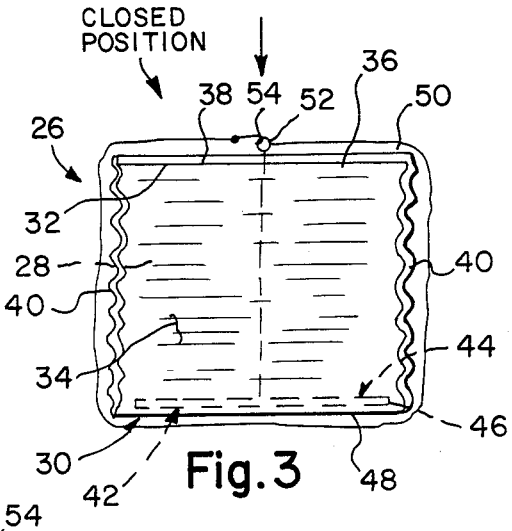
FIG. 3 is an elevational view of another modification being in a closed position.
Figure 4:
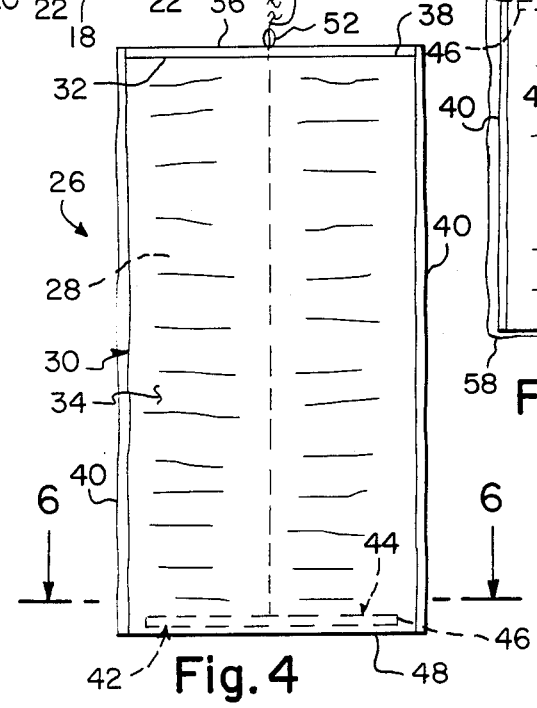
FIG. 4 is an elevational view of the modification being in an open position.

FIGS. 3 to 6 show another type of coffee bag 26 that consists of a portion of very fine ground coffee 28 for making an individual cup of coffee. A cylindrical housing 30 is provided, which has an open top 32 and is fabricated out of water-permeable paper material 34 for holding the very fine ground coffee 28 therein. A perforated disc 36 is heat sealed at 38 around perimeter of the open top 32 of the housing 30. The coffee bag 26 also includes a pair of spring strips 40 each of which is vertically suspended from an opposite edge of the perforated disc 36 and is attached along side of the housing 30. When the housing is inserted within a cup of hot water the spring strips 40 will extend downwardly to help the housing 30 to go from a collapsed position as shown in FIG. 3 to an extended position as shown in FIG. 4. Also shown is a device 42 for agitating the very fine ground coffee 28 is within the housing 30.

The device 42 consists of a member 44 that has a plurality of radial fingers 46 located in bottom 48 of the housing 30 below the very fine ground coffee 28. An elastic cord 50 extends upwardly from center of the member 44 and out through the perforated disc 36. When a person pulls the elastic cord 50 after the housing 30 is inserted within the cup of hot water the member 44 with the radial fingers 46 will agitate the very fine ground coffee 28.

An eyelet 52 is mounted adjacent to top center of the perforated disc 36. A hook 54 is attached to free end of the elastic cord 50 so that when the housing 30 is in the collapsed position the elastic cord 50 is wrapped from top to bottom around the housing with the hook 54 engaging the eyelet 52 to help keep the housing in the collapsed position.

As evident from the description and FIGS. 3–7, the spring strips 40 are merely strips of springing material which would expand if not restrained to a collapsed condition by the elastic cord 50 as seen in FIG. 3. When hook 54 is detached from eyelet 52 and then suspended in liquid the spring strips 40 expand aided by the increased weight of the soggy coffee grounds on the bottom 48 of the bag to cause elongation of the bag.

Figure 7:
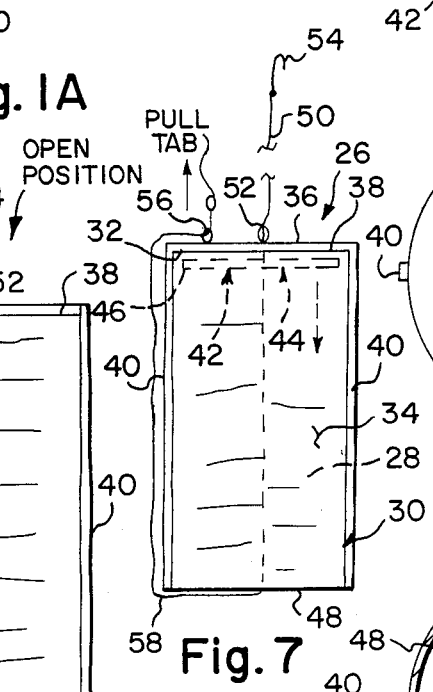
FIG. 7 is an elevational view of still another modification showing a second cord to return the inner member with radial fingers downwardly.
Figure 5:
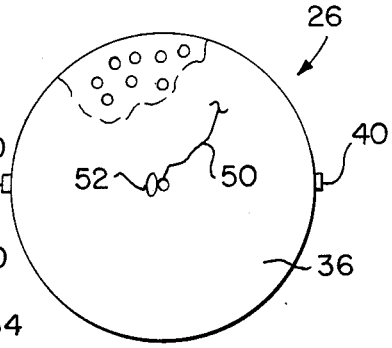
FIG. 5 is a top view showing the perforated disc as indicated by arrow 5 in FIG. 3.
Figure 6:
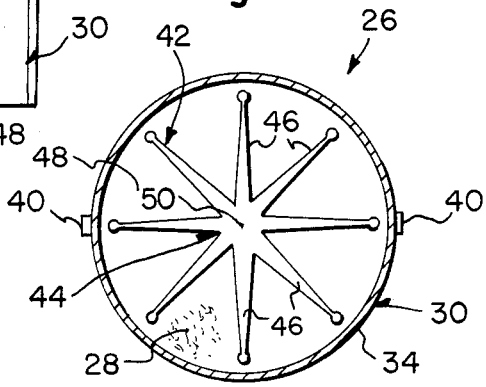
FIG. 6 is a cross sectional view taken along line 6—6 in FIG. 4 showing the inner member with radial fingers connected to the cord to agitate the ground coffee inside the housing of the bag.

FIG. 7 shows a modification to the coffee bag 26 that includes a second eyelet 56 mounted to top of the perforated disc 36. A second elastic cord 58 extends downwardly from center of the member 42, which has the radial fingers 46, out through bottom 48 of the housing 30 and upwardly along side of the housing through the second eyelet 56. A pull tab 60 is attached to free end of the second elastic cord 58 so that when a person pulls the pull tab 60 the second elastic cord 58 will pull down the member 42 to return it to bottom 48 of the housing 30.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A coffee bag comprising:

(a) a portion of very fine ground coffee for making an individual cup of coffee;

(b) a cylindrical housing having an open top and fabricated out of water-permeable paper material and containing said very fine grounds of coffee therein;

(c) a perforated disc heat sealed to and around the perimeter of said open top of said housing;

(d) a pair of spring strips restraining said housing in a collapsed condition, each of said spring strips being vertically suspended from an opposite edge of said perforated disc and attached along the side of said housing, the spring strips are such that when said housing is inserted into liquid said spring strips will extend downwardly aided by the then soggy coffee grounds weight to help said housing to expand to an extended position; and (e) means for agitating said ground coffee within said housing when said bag is inserted into said liquid; said agitating means comprising a member having a plurality of radial fingers located in the bottom of said housing below said very fine ground coffee and an elastic cord extending upwardly from the center of said member and out through said perforated disc so that when a person pulls said elastic cord after the housing is inserted within a cup of hot water, said member with said radial fingers will agitate said very fine ground coffee; said coffee bag further comprising an eyelet mounted adjacent to the top center of said perforated disc and a hook attached to the free end of said elastic cord with said elastic cord wrapped from top to bottom around said housing with said hook removably engaging said eyelet to help keep said housing in said collapsed position.

2. A coffee bag as recited in claim 1, further comprising:

(a) a second eyelet mounted to the top of said perforated disc;

(b) a second elastic cord extending downwardly from the center of said member having said radial fingers, out through the bottom of said housing and upwardly along side of said housing through said second eyelet; and (c) a pull tab attached to the free end of said second elastic cord so that when a person pulls said pull tab said second elastic cord will pull down said member to return it to the bottom of said housing.

* * * * *